US009978193B2

(12) United States Patent
Briskey

(10) Patent No.: US 9,978,193 B2
(45) Date of Patent: May 22, 2018

(54) LOCKBOX ACCESS DEVICE AND METHOD WITH BIOMETRIC SECURITY DATA

(71) Applicant: Carrier Corporation, Jupiter, FL (US)

(72) Inventor: Teri Lynné Briskey, Monmouth, OR (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days. days.

(21) Appl. No.: 15/803,572

(22) Filed: Nov. 3, 2017

(65) Prior Publication Data

US 2018/0075676 A1 Mar. 15, 2018

Related U.S. Application Data

(62) Division of application No. 15/143,539, filed on Apr. 30, 2016, now Pat. No. 9,836,897.

(60) Provisional application No. 62/155,401, filed on Apr. 30, 2015.

(51) Int. Cl.
*G07C 9/00* (2006.01)

(52) U.S. Cl.
CPC ..... *G07C 9/00087* (2013.01); *G07C 9/00103* (2013.01); *G07C 9/00571* (2013.01)

(58) Field of Classification Search
CPC ..... G07C 9/00158; G07C 9/00563; G07C 9/00087; G07C 2009/00095; G07C 9/00111; G07C 9/00079; G07C 9/00039; G07C 9/00174
USPC ..... 340/5.53
See application file for complete search history.

(56) References Cited

U.S. PATENT DOCUMENTS

| | | | |
|---|---|---|---|
| 4,864,115 | A | 9/1989 | Imran et al. |
| 5,475,375 | A | 12/1995 | Barrett et al. |
| 5,654,696 | A | 8/1997 | Barrett et al. |
| 6,822,553 | B1 | 11/2004 | Henderson et al. |
| 6,842,105 | B1 | 1/2005 | Henderson et al. |
| 7,026,928 | B1 | 4/2006 | Lane |
| 7,606,558 | B2 | 10/2009 | Despain et al. |
| 7,880,584 | B2 | 2/2011 | Larson et al. |
| 8,058,971 | B2 | 11/2011 | Harkins et al. |
| 8,335,488 | B2 | 12/2012 | Despain et al. |

(Continued)

OTHER PUBLICATIONS

Melissa Dittman Tracey, Real Estate's 6 Most Dangerous Everyday Situations, Sep. 2010, National Association of Realtors, Chicago, Illinois, retrieved Mar. 2, 2015 from http://realtormag.realtor.org/sales-and-marketing/feature/article/2010/09/real-estates-6-most-dangerous-everyday-situations.

(Continued)

*Primary Examiner* — Mark Blouin
(74) *Attorney, Agent, or Firm* — Bachman & LaPointe, P.C.

(57) ABSTRACT

A lockbox access apparatus comprising a wireless communications device having a stored program configured to: cause the wireless communications device to communicate an access request to a lockbox; and receive lockbox identifying information from the lockbox. The wireless communication device is further configured to: record biometric identifying information of an individual; take entry from a user of non-biometric identifying information of the individual; and transmit the lockbox identifying information, the biometric identifying information, and the non-biometric identifying information to a remote destination.

24 Claims, 6 Drawing Sheets

(56) References Cited

U.S. PATENT DOCUMENTS

| | | | | |
|---|---|---|---|---|
| 8,335,491 | B1 | 12/2012 | Kovach | |
| 8,437,740 | B2 | 5/2013 | Despain et al. | |
| 8,500,009 | B2 | 8/2013 | Clapsaddle | |
| 8,624,727 | B2 | 1/2014 | Saigh et al. | |
| 8,630,820 | B2 | 1/2014 | Amis | |
| 8,862,092 | B2 | 10/2014 | Reitnour | |
| 2005/0091277 | A1 | 4/2005 | Desman | |
| 2009/0284578 | A1 | 11/2009 | Carter | |
| 2012/0095790 | A1* | 4/2012 | Stefik | G06Q 10/02 705/5 |
| 2013/0254396 | A1 | 9/2013 | Robertson | |
| 2013/0307670 | A1* | 11/2013 | Ramaci | G06F 21/6245 340/5.82 |
| 2013/0311253 | A1 | 11/2013 | Sabella | |
| 2014/0049653 | A1 | 2/2014 | Leonard et al. | |
| 2014/0214499 | A1* | 7/2014 | Hudson | G07F 17/246 705/13 |
| 2015/0091696 | A1 | 4/2015 | Fisher | |
| 2016/0049034 | A1* | 2/2016 | Stradiota | G07C 9/00563 340/5.53 |

OTHER PUBLICATIONS

New Key Box secures large key fobs, Nov. 2013, Supra, Salem, Oregon.

Supra eKey for Apple Products User Manual, Nov. 2013, Supra, Salem, Oregon.

Realtor Safety Presentation, Sep. 2011, National Association of Realtors, Chicago, Illinois, retrieved Mar. 2, 2015 from http://www.realtor.org/sites/default/files/presentations/2011/realtor-safety-presentation-2011-safety-with-clients.pdf.

* cited by examiner

LOCKBOX ACCESS DEVICE AND METHOD WITH BIOMETRIC SECURITY DATA

CROSS-REFERENCE TO RELATED APPLICATIONS

This is a divisional application of U.S. patent application Ser. No. 15/143,539, filed Apr. 30, 2016, and entitled "Lockbox Access Device and Method with Biometric Security Data", and benefit is claimed of U.S. Patent Application No. 62/155,401, filed Apr. 30, 2015, and entitled "Lockbox Access Device and Method with Biometric Security Data", the disclosures of which are incorporated by reference herein in their entireties as if set forth at length.

BACKGROUND

This application relates to key control systems and methods, particularly those that include a lockbox located near a premises to which controlled access is to be permitted under specified conditions, and other related security applications.

A lockbox, sometimes referred to as a "keybox," has a locked compartment within which a key to a conventional lock or other physical access device or asset can be stored. In typical uses, the lockbox is positioned near a premises to which controlled access is desired, e.g., a home or other dwelling, a commercial building or site, or virtually any other type of premises, and a conventional key to open a lock securing the premises is stored within the locked compartment. Lockboxes are widely used by real estate agents to facilitate the showing of listed properties. Lockboxes are also used in commercial and industrial settings to facilitate access to secured premises, particularly when the premises are otherwise unattended, such as in the case of accesses that take place after hours or at many geographically dispersed locations.

The lockboxes of primary interest here have electronically or electrically actuated locks that are capable of receiving unlocking signals transmitted wirelessly. Such lockboxes may have, e.g., a receiver for an infrared, radio or other type of wireless signal. The unlocking signals are sent by access devices, sometimes referred to as electronic keys.

A person recognized as a key control system user can use her access device to transmit a request to access a premises within the system that is secured by a lockbox. In general terms, the system determines whether the user's access request is to be granted, and, if so, enables the user to unlock the lockbox and access its contents. In a typical scenario, the lockbox contains a conventional key to the locked premises and the user uses the key stored in the lockbox to unlock the premises and gain physical access to it.

The system typically includes tracking capabilities that record the user's identity, the time of the access request, the premises to which access is requested, etc. The system may also include capabilities to communicate between a central authority and the user to convey information such as updates, messages, commands, etc.

United States Patent Application publication 20110053557 A1 of Despain et al., published Mar. 3, 2011, and entitled KEY CONTROL WITH REAL TIME COMMUNICATIONS TO REMOTE LOCATIONS discloses exemplary baseline systems.

SUMMARY

One aspect of the disclosure involves a lockbox access apparatus comprising a wireless communications device having a stored program configured to: cause the wireless communications device to communicate an access request to a lockbox; and receive lockbox identifying information from the lockbox. The wireless communication device is further configured to: record biometric identifying information of an individual; take entry from a user of non-biometric identifying information of the individual; and transmit the lockbox identifying information, the biometric identifying information, and the non-biometric identifying information to a remote destination.

In one or more embodiments of any of the other embodiments, the stored program is configured to receive said lockbox identifying information as a result of the communication of the access request.

In one or more embodiments of any of the other embodiments, the stored program is configured to prompt the user for: entry of the biometric identifying information and non-biometric identifying information; or selection of already stored biometric identifying information.

In one or more embodiments of any of the other embodiments, the biometrtic identifying information comprises a photograph.

In one or more embodiments of any of the other embodiments, the stored program is configured to prompt the user for entry of personal security information of the user.

In one or more embodiments of any of the other embodiments, the personal security information is a PIN.

In one or more embodiments of any of the other embodiments, the wireless communications device is a wireless telephone.

In one or more embodiments of any of the other embodiments, the wireless communications device is configured to initiate the communication to the selected destination via a data communication sent over the wireless communications device's wireless carrier network.

In one or more embodiments of any of the other embodiments, the selected destination to which the wireless communications device initiates the communication includes a central authority having a computer receptive to communications from the wireless communications device over the wireless communications device's wireless carrier network.

In one or more embodiments of any of the other embodiments, the wireless communications device and the lockbox are configured such that the access request is communicated wirelessly.

In one or more embodiments of any of the other embodiments, the wireless communication includes Bluetooth communication.

Another aspect of the disclosure involves a method for using the apparatus. The method comprises: recording with the wireless communication device said biometric identifying information of the individual; communicating via the wireless communications device the access request to the lockbox and transmitting with the wireless communication device the lockbox identifying information, the biometric identifying information, and the non-biometric identifying information to said remote destination.

In one or more embodiments of any of the other embodiments, the method further comprises taking entry with the wireless communication device of said non-biometric identifying information.

In one or more embodiments of any of the other embodiments, the recording is via taking a digital photograph.

In one or more embodiments of any of the other embodiments, the lockbox is used to secure a key to a premises and the individual is a visitor.

In one or more embodiments of any of the other embodiments, the lockbox is used to secure a key to a vehicle and the individual is a prospective test driver of the vehicle.

Another aspect of the disclosure involves a lockbox access apparatus system comprising one or more servers having a stored program configured to: receive from a wireless communication device: lockbox identifying information, biometric identifying information of an individual seeking access to a property secured via the lockbox, and non-biometric identifying information of the visitor.

In one or more embodiments of any of the other embodiments, the system further comprises the lockbox.

In one or more embodiments of any of the other embodiments, the stored program is configured to: generate a report output for a remote device that includes, in visual form, the biometric identifying information and the non-biometric identifying information.

In one or more embodiments of any of the other embodiments, the system further comprises at least one said wireless communication device.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Described below are implementations of a key control system in which at least one premises is secured by a lockbox securing the key to the premises. There is a least one mobile telephone associated with a user seeking to access the lockbox and programmed with the capability to make an access request to the lockbox.

In the real estate context, some lockboxes may be open to all authorized accesses without constraints, such as, e.g., the time of day for the requested access or who is present to accompany the user during the visit to the premises. For such a lockbox subject to open access, the only requirement is that the user be authorized, e.g., being recognized as user within the key control system and/or having up-to-date credentials for the type of access being requested. Assuming the user is authorized, the user simply makes the access request with his mobile telephone, which typically requires entry of a PIN or other similar code, and the lockbox is unlocked to allow the user to access the key to the premises.

Figure 1:
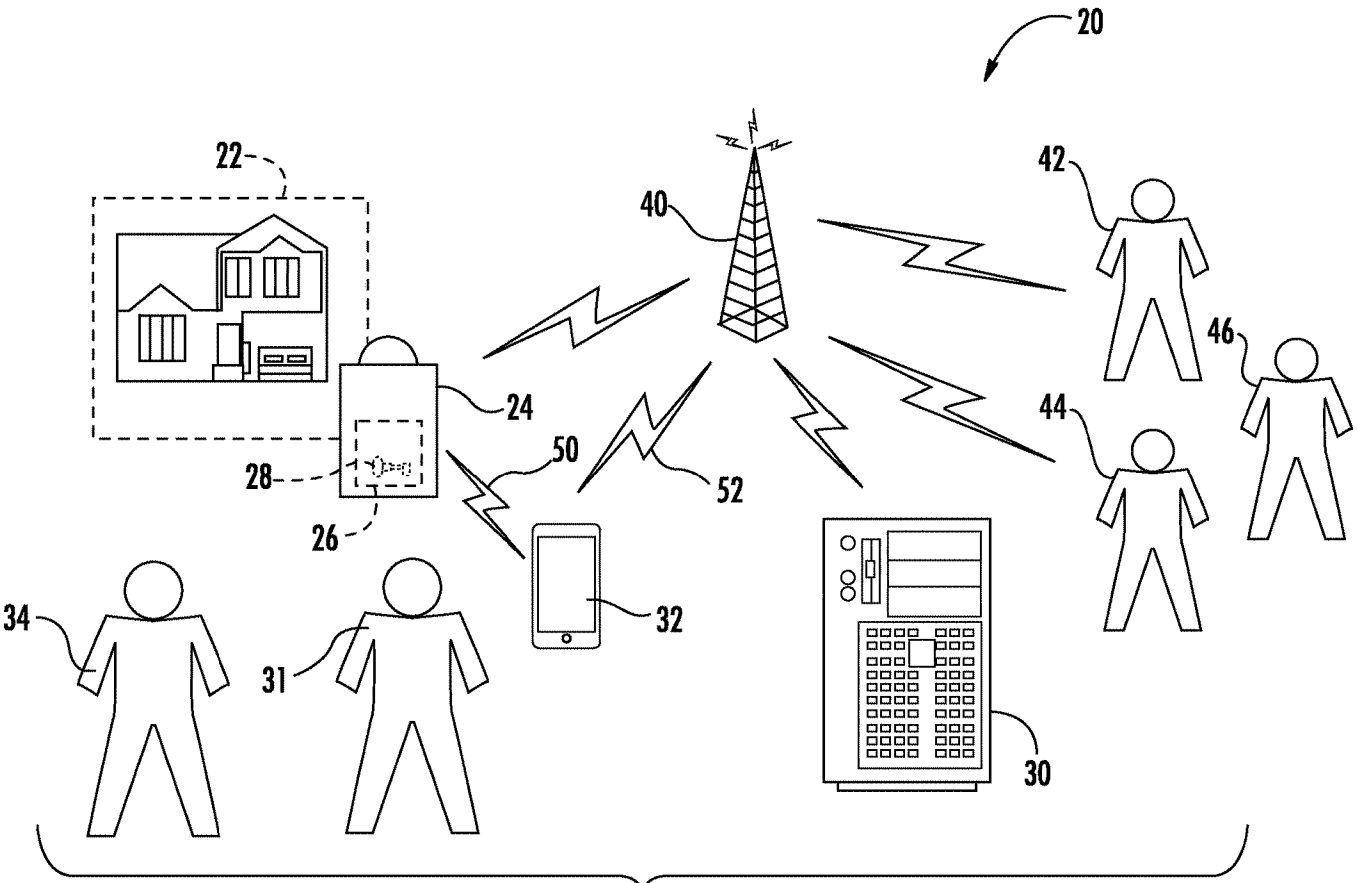
FIG. 1 is a conceptual network diagram showing a first embodiment of a key control system with real-time communications features, in which a premises is secured by a lockbox, a user accesses the lockbox with a mobile phone and a central authority administers authorization to access the lockbox.

FIG. 1 illustrates a first embodiment of a key control system 20. At least one premises 22 is secured with a lockbox 24 having a locked compartment 26 in which a key 28 to the premises 22 is stored. The system 20 also includes a central authority 30. At least one user 31 has a mobile telephone 32. As is discussed below, the mobile telephone runs software in the form of an access app loaded onto the mobile phone and assigned to the user. FIG. 1 also shows a prospective visitor 34. As is discussed further below, the exemplary user 31 is a real estate agent (showing agent) and the prospective visitor 34 is a prospective buyer to whom the user 31 intends to show the premises. As is discussed below, by way of non-limiting example, the showing agent is identified via feminine pronouns and the visitor is identified via masculine pronouns.

The central authority 30 and the mobile telephone 32 can communicate with each other over a wireless service network 40 (optionally including hard links such as wired or fiber optic Internet links). More particularly, the access app using the operating system and hardware of the mobile phone may communicate with the central authority. Other parties may also communicate with the central authority and/or the mobile telephone 32 via the network 40 or otherwise. Among examples are the listing agent (or agency) 42, the user's agency 44, and a board or association 46 (e.g., a regional real estate board that manages credentials within a geographic region). Access of these parties may be via the internet or successor network using hardware (servers, computers, or even mobile phones, of those respective users). Exemplary such user access is web-based html via a browser or via mobile phone app (which might be the same access app escribed herein). Typically, but not necessarily, the premises, the central authority and the other parties are remotely located from each other (often, however, the listing agency may be the user's agency; in some implementations, the regional board or the like might also serve as the central authority).

The central authority administers the access privileges of users and the access preferences of approval parties for premises and lockboxes within the system. The central authority includes one or more computers or servers with appropriate communications equipment for communications over at least the wireless service network, and possibly other public and/or private networks. These computers or servers individually and/or collectively may include appropriate processors, memory, storage, communications interfaces, and the like. The processor and memory execute programs held in the storage to perform basic computer functions and the specific functions associated with acting as a central authority. The central authority typically includes a database in said storage, which typically includes an identification of each user, her status, the access app on the mobile telephone assigned to the user, each premises within the system and its status, and each lockbox within the system and its status, etc. Through communication links, the central authority may optionally provide other services, including informational updates, programming updates, and references.

The mobile telephone is typically a cellular telephone, a satellite telephone or similar portable wireless communications device with at least a voice channel for communicating within or among wireless service networks, such as the wireless service network. Advantageously, networks that support at least one data channel in addition to the voice channel provide enhanced capabilities. Several such cellular networks, as well as their associated cellular telephone handsets and communications protocols, are referred to as GPRS over GSM, 1×RTT over CDMA, and LTE. Of course, other similar networks, whether they exist currently or will be developed in the future, can also be used.

The mobile telephone is programmed to function as an access device. In exemplary implementations, the mobile telephone is a "smartphone" such as those running the Android™ operating system of Google Inc., of Mountain View, Calif., or the iOS™ operating system of Apple Inc., of Cupertino, Calif., or the BlackBerry™ operating system of BlackBerry Limited, of Waterloo, Ontario. Such smartphones may function as computers having one or more processors, memory, and storage. The mobile telephone is programmed with the access app that allows it to communicate wirelessly with the lockbox. For example, the mobile telephone and the lockbox can have transceivers and associated circuitry to enable infrared (IR) or other form of optical or radiofrequency (RF) (e.g., Bluetooth™ (certification mark of Bluetooth SIG, Inc., Kirkland, Wash.) or near field communication (NFC)) communication when within proximity of each other. One suitable infrared communication protocol is the IrDa™ (Infrared Data Association, Walnut Creek, Calif.) standard.

As a first layer of security in the exemplary baseline system, the exemplary access app, once installed, must be enabled by a software license given to the user after the user is initially registered (and whose information has thus been put into the central authority's server(s)). Various security features can be implemented if desired. These may include things such as: requiring PIN code entry upon attempts to make access requests; and challenge/response schemes.

The exemplary baseline system is one that does not require real-time communication between the mobile phone and the central authority at the premises. This, for example, allows the system to work where the premises is outside of mobile telephone/data coverage. However, where coverage is available, the system may make use of real-time communication. In that exemplary baseline system, the electronic key in the mobile telephone is periodically updated when communication is available.

For example, the access app may be freely distributed (e.g., via a phone manufacturer app store, carrier app store, OS vendor app store, or other download). There may then be one or more layers of security. An exemplary first layer involves getting a license key to activate the software. This license key may be provided directly or indirectly by the proprietor of the central authority or by an entity that has contracted with the central authority. For example, a regional real estate board (with whom the user registers) may issue the user a license key. The user may then enter the license key into the access app to initially activate the access app for use with lockboxes that are also registered with that regional real estate board.

As a second layer of security, the status of the access app may be updated/revalidated/renewed periodically (e.g., nightly). This update/revalidation/renewal process provides a layer of security against the user losing control of the mobile telephone or the user otherwise losing her rights. This update may take the form of the access app receiving (e.g., retrieving) an update code.

In the baseline system, as a third security layer, once in proximity to the lockbox, completes a biometric or non-biometric security check such as entering a personal identification number (PIN) into the app. Upon gaining access to the lockbox, the mobile telephone may communicate a record of such access to the central authority. Where real time communication is available, this may be essentially instantaneous. Otherwise, it may occur when appropriate coverage is reestablished.

A modification from the baseline system involves using the mobile telephone's capability to record biometric identifying information about the prospective visitor 34 (or visitors if multiple visitors are being shown the premises at once). Exemplary capability may be provided by the camera of the mobile telephone. Exemplary biometric identifying information is one or more photographs of each visitor or of his driver's license bearing a photograph. The mobile telephone further has the capability to take entry of non-biometric identifying information about the prospective visitor (or visitors if multiple visitors are being shown the premises at once). Exemplary capability may be provided by the physical or virtual (e.g., touchscreen) keyboard of the mobile telephone or onboard or remote speech recognition. Exemplary non-biometric identifying information is name and address.

Figure 3:
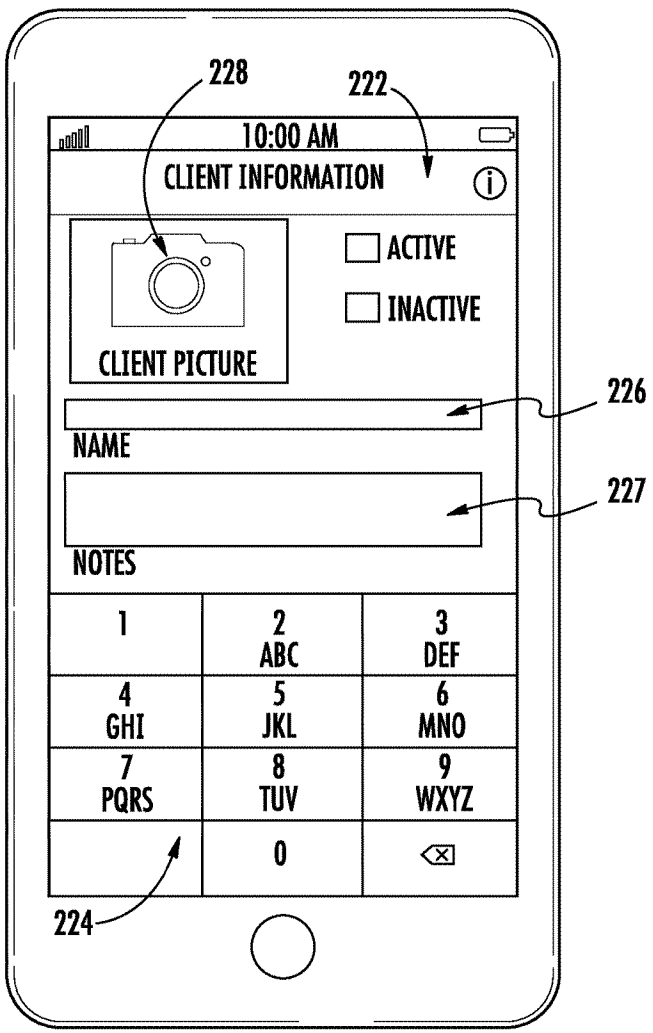
FIG. 3 is a simplified empty client information menu of the app.
Figure 2:
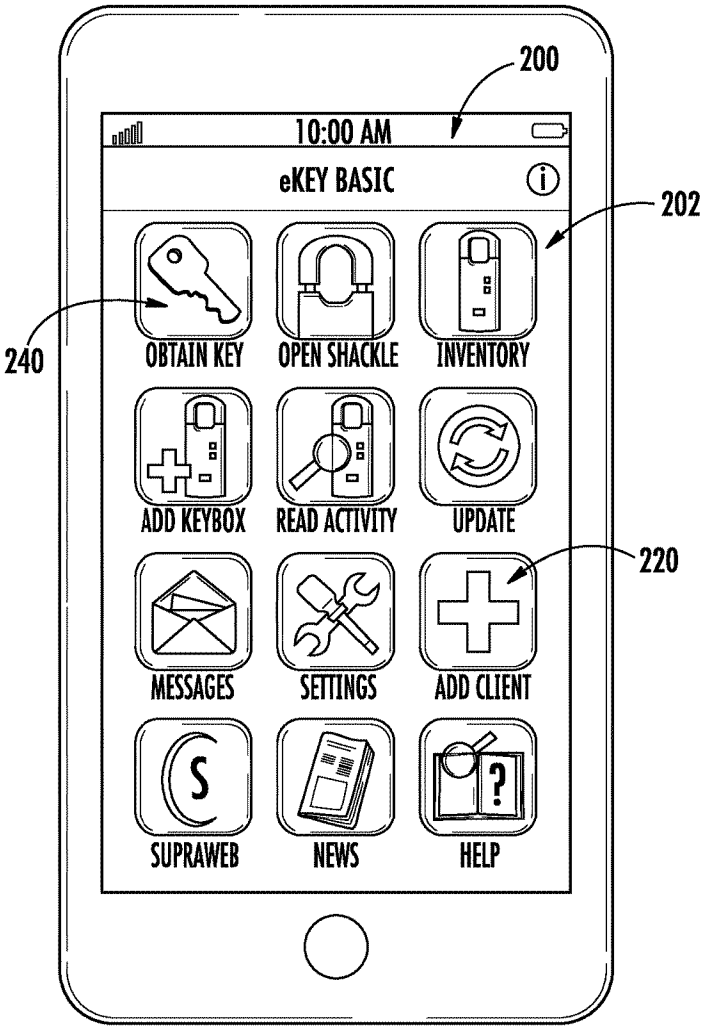
FIG. 2 is a simplified main menu of an access app on a mobile phone.

The mobile telephone may retain a dedicated or general client list (e.g., address book) which may contain the biometric identifying information and non-biometric identifying information of the visitor(s). FIG. 2 shows the user interface of the mobile phone including an operating system header 200 and a main menu 202 of the app. The main menu of the app may be launched from a home page (not shown) of the mobile phone such as via an icon, tile, button, or the like. For ease of reference, the term "button" will collectively reference such user interface options. The user interface (e.g., main menu 202 of the app) may have one or more buttons 220 for adding to or editing the client list. In the illustrated example, only an add client button is shown. Touching or otherwise selecting the add client button may launch an add client screen or menu 222 (FIG. 3). This may include an appropriate virtual keyboard for data entry. Alternatively, the virtual keyboard may be launched via touching or otherwise selecting a text entry field. The exemplary illustrated text entry fields include a visitor/client name field 226 and a note field 227. Other fields might include address or other identifying information.

Figure 4:
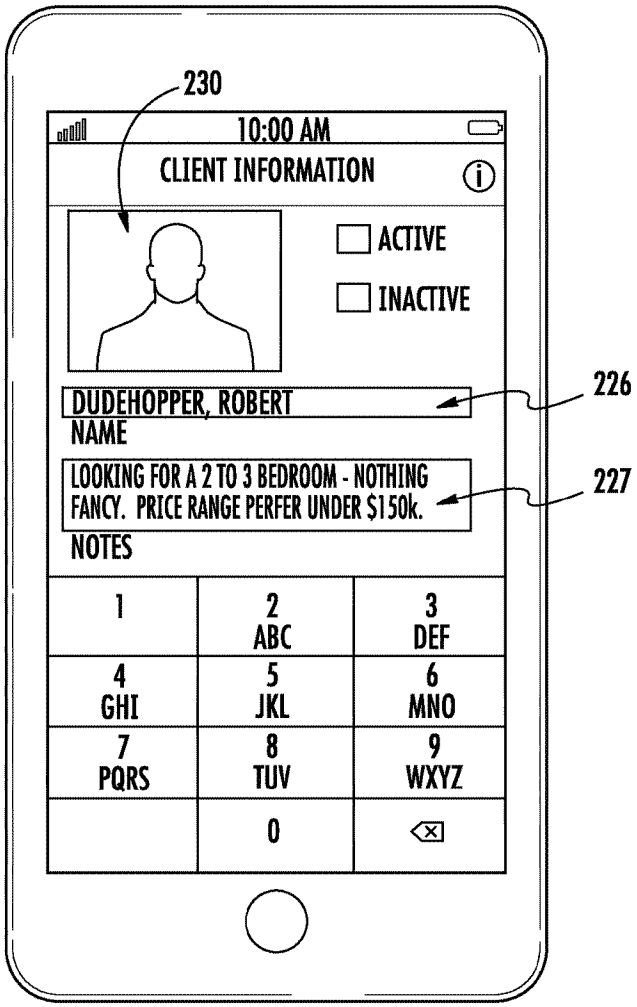
FIG. 4 is an exemplary completed client information menu of the app.

FIG. 3 also shows an icon 228 serving as a placeholder for a client photograph. This icon 228 may thus have graphical and/or text indicia perceptible by the user as being a photograph placeholder and/or a button for adding a photograph. In this example, touching or otherwise selecting the button 228 may bring up the phone's camera interface (not shown), or launch a dedicated camera interface specific to the app (also not shown), or may launch the phone's native photo album, picture gallery, or the like (also not shown) so the user may select a photograph already taken of the visitor using the phone's camera. The user may use such interface to take a picture of the visitor or his photographic driver's license or other biometric identification. The user may also select the text fields to enter information via the keyboard 224. FIG. 4 shows a completed client list or address book entry including completed text fields 226, 227 and a photograph 230 in place of the icon/button 228. The exemplary photograph 230 may be a low resolution thumbnail of a higher resolution photograph stored by the app in the address book. Various routine functionalities for apps and their associated buttons (such as for saving the information, editing the information, and/or deleting the information) are not shown or discussed but may exist in any particular implementation.

Figure 5:
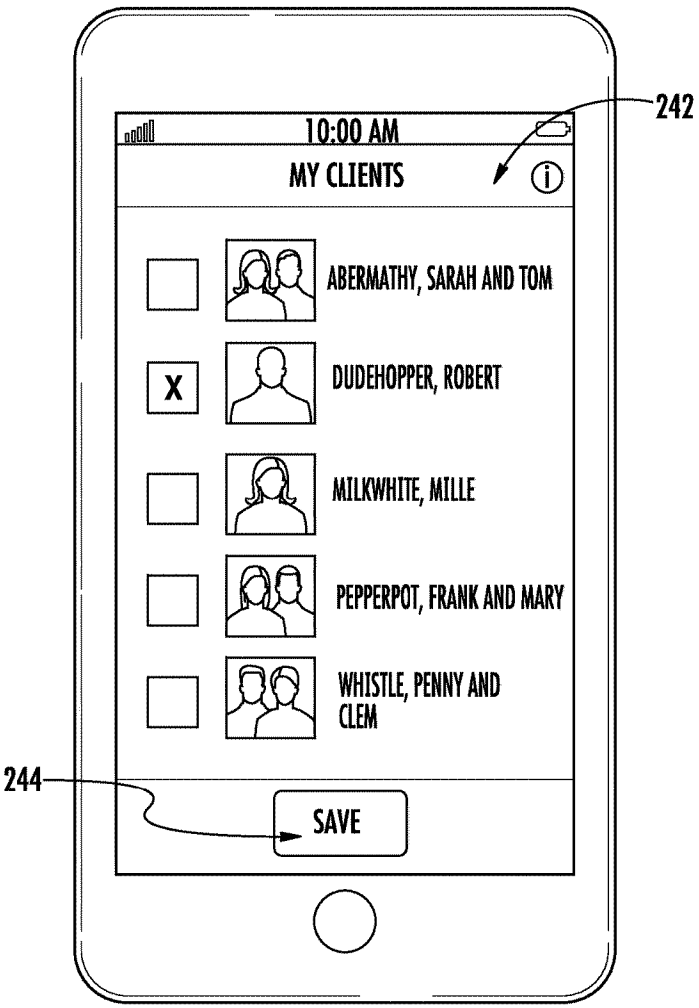
FIG. 5 is an exemplary client list menu of the app.
Figure 6:
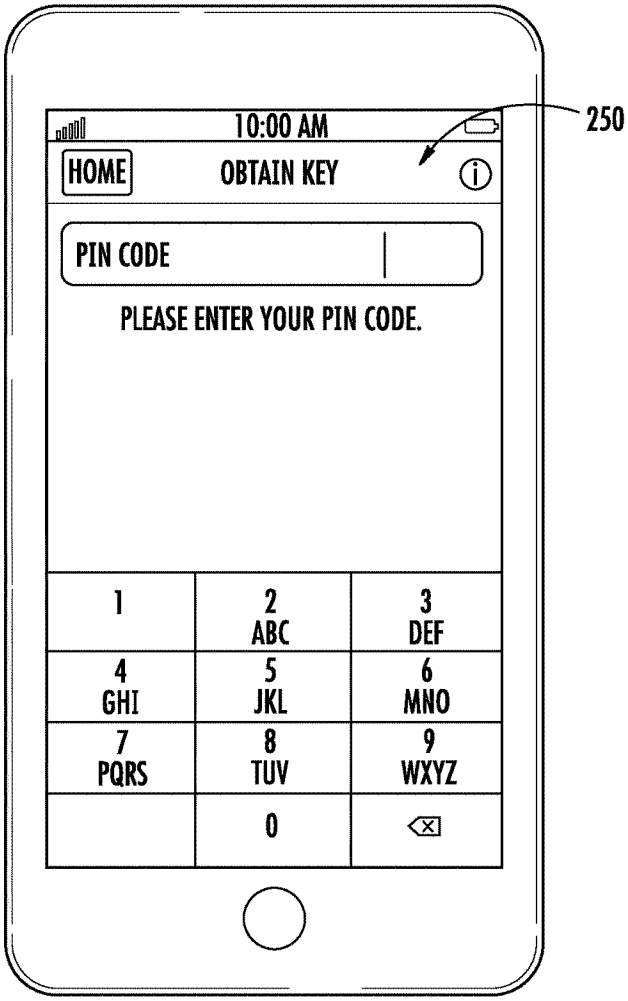
FIG. 6 is an exemplary PIN entry menu of the app.

The user interface also has a button 240 (FIG. 2) for requesting opening of a lockbox. At some point prior to opening the lockbox key container to obtain the key, the app may prompt the user to select and/or edit and/or add sufficient client information to identify the visitor. For example the app may prompt the user to select or add a client from/to the client list. FIG. 5 shows a client list menu/interface 242 which may be launched responsive to the user pressing the button 240. The exemplary interface 242 has a checkbox beside each entry and may have a save or select button 244 which consummates the selection. For example, this may allow the selection of multiple parties if multiple checkboxes are checked. Yet other variations are possible. If the user selects a given entry, there may be a further prompt to add further information if the existing information is not sufficient (e.g., if there is only non-biometric information for the selected visitor, the interface prompts the taking of a photograph). For example, the selection of an insufficient entry may re-launch the menu 222 populated with the partial information contained in the client list and highlighting any information that needs to be completed. If sufficiency is determined, the app may launch a security screen 250 in order to have the user enter her security information (e.g., PIN) (FIG. 6)). Having the security information entry occur only after sufficient visitor information has been entered provides an additional layer of security. This is contrasted with a system wherein the security entry information is entered initially (in which case, a visitor could then seize the phone and enter false information to obtain access).

If the mobile telephone has a removable memory element, e.g., such as a SIMM card, the access device application may be stored on that element. Alternatively, part or all of the application may be stored in the permanent or dedicated memory of the mobile telephone.

Communication established between the mobile telephone and the lockbox is referred to as communication over a "first" communications link 50. There is a "second" communications link 52 representing communications to and from the mobile telephone over the wireless service network. In the implementation of FIG. 1, the second communications link is the link between the mobile telephone and the central authority over the wireless service network.

In one example, the lockbox has active electronic transmit and receive circuitry (e.g., over Bluetooth wireless protocol). The exemplary lockbox thus has a battery power supply and a transmitter/receiver unit (inclusive of separate units). The lockbox may have a processor, memory, and storage for storing and executing a program to perform the required steps. The processor may be coupled to an actuator for unlocking the lockbox (optionally also locking the lockbox or the lockbox may automatically mechanically lock when closed by the user).

Figure 8:
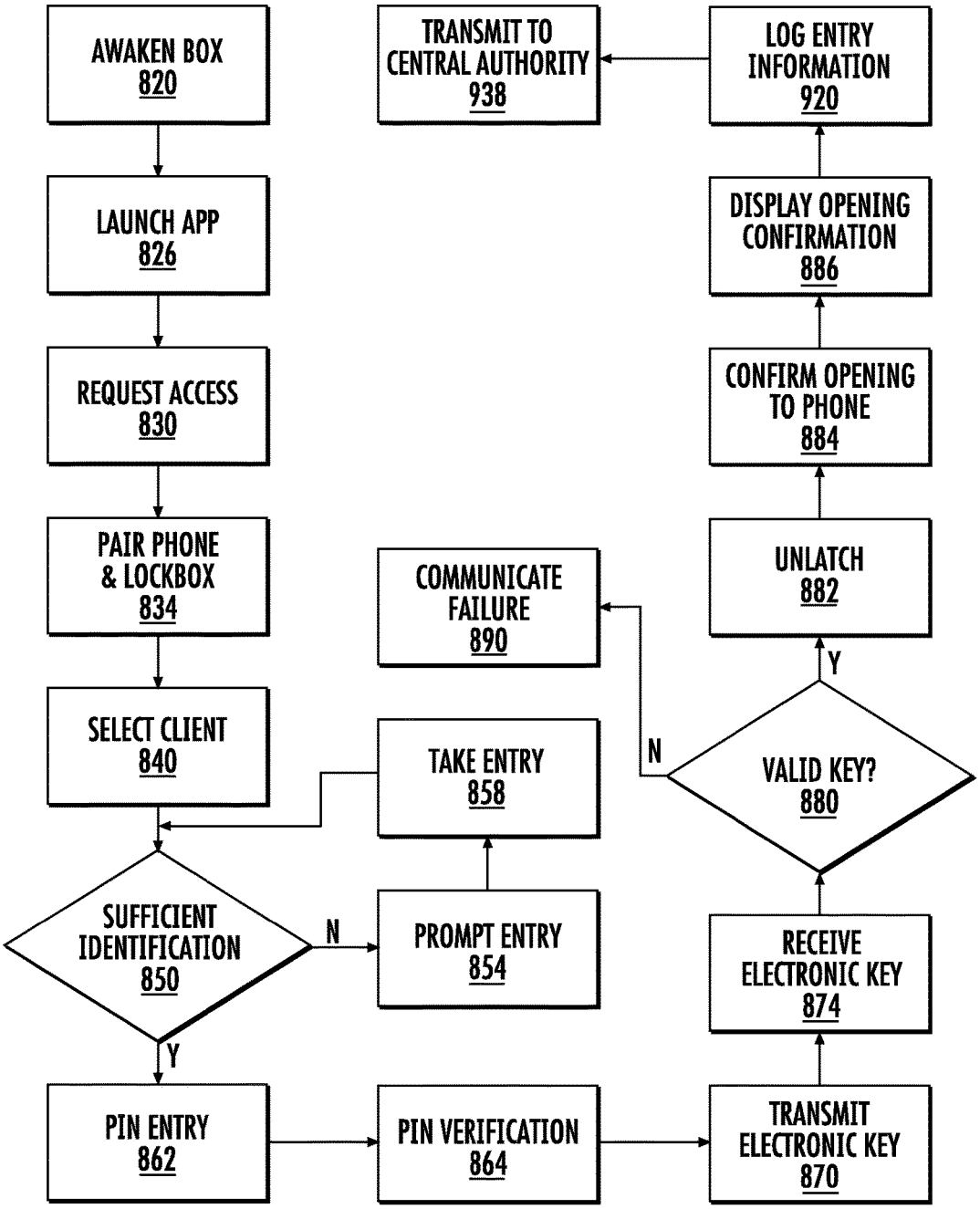
FIG. 8 is a flowchart of an exemplary access process.

Referring to the flowchart of FIG. 8, one implementation of a method 800 begins with the user 31 and visitor 34 being in proximity of the secured premises 22. The user locates the lockbox 24 and uses the authorized app on the mobile telephone to establish the first communications 50.

The lockbox may have a mechanical input device such as a pushbutton switch coupled to the electronics for awakening the lockbox from a power-saving sleep mode. In one example, the user actuates the mechanical switch to wake up 820 (FIG. 8) the lockbox. The lockbox may wake up into a Bluetooth pairing mode.

In one example, the user launches 826 or unminimizes the access app on the mobile telephone. The main menu on the app may have several options (e.g., identified by respective icons, tiles, virtual buttons, or the like). One option may be to enter information for a new client (e.g., button 220 of FIG. 2) or edit information for an existing client. This might be expressed as a single initial option followed by a hierarchical chain or may initially be represented by several different buttons, etc. for the different options. This client entry or editing step may be performed outside of proximity to the premises (e.g., when back at a real estate office or elsewhere). As noted above, the button or a subsequent button in a hierarchy will specify the collecting of biometric identifying information such as taking of a photograph of the user or of his driver's license or other identification.

Another high level option on the user interface of the access app is to access/open the lockbox to obtain the key from the lockbox (e.g., button 240 of FIG. 2). In one group of examples, commanding 830 (FIG. 8) the request access or obtain key function (e.g., via button 240) may place the phone in a pairing mode (e.g., Bluetooth pairing mode) for establishing the basic communications link with the lockbox. If the lockbox has previously been awakened the phone and lockbox will pair 834. In those or yet other examples, this may occur at different points in the process (depending on the particular user interface and on how one got to a particular stage). In the exemplary implementation, if the lockbox has not been awakened, the app may attempt to communicate with the lockbox and fail and then prompt (menu not shown) the user to awaken the lockbox. The app may, after a short delay, reattempt communication or may respond to communication initiated by the lockbox or may re-prompt the user with a button to command the app to commence such pairing. In any event, the exemplary result is an initial communications (Bluetooth) pairing 834 of the lockbox and mobile phone.

Responsive to selection 830 of the request access menu option, the app may also prompt the user to select 840 a client from the client list (FIG. 5) stored in the mobile telephone. Again, there are many options for verticality or horizontality of the menu. For example, a horizontal menu may have separate options for selecting an existing client or adding a new client. If an existing client is selected, the app may verify 850 that sufficient data is present for that client (e.g., completed fields for name, address, and/or other non-biometric information, and completed fields regarding the biometric identifying information (e.g., photograph)). If insufficient information is determined, the app may prompt 854 entry 858 of missing information (e.g., prompting the user to use the mobile telephone to record the biometric identifying information and /or non-biometric identifying information).

In further variations, the access lockbox function may be accessed directly from the client list or directly from the final menu used to enter or edit the biometric and/or non-biometric identifying information. Thus, a command for any of these steps may initiate pairing.

Among alternative variations are those where pairing begins only after sufficiency is determined by the phone.

Yet various alternative security handshake protocols may be used.

With sufficient non-biometric and biometric identifying information entered or a client record having such sufficient information selected, communication between the mobile telephone and the lockbox may commence (or substantive communication may commence if certain formalities such as the Bluetooth pairing had already occurred). The app may commence this communication automatically or the app may prompt the user to enter a further user command (e.g., after a verification message confirms sufficiency of entered or selected client information the app menu may include a button to begin the communication). However, in the exemplary embodiment, the further security step is taken of having the user enter her pin. The exemplary PIN interface of FIG. 6 may be launched by the app immediately upon confirmation by the access app of sufficient visitor information entered or selected. After PIN entry 862 and verification 864, communication with the lockbox may be automatic or may require yet a further user command.

In the exemplary embodiment, the signal broadcast by the mobile telephone embeds electronic key information 870 that is received 874 by the lockbox. The lockbox's programming then determines 880 the validity of the electronic key. As noted above, this may be done via any of numerous known or yet-developed protocols. In one exemplary protocol, in step 870 the access app sends the lockbox one or more packages of data (called cookies) that each contain a string of information. This information may include identification information for the user (whether a user number or actual name, affiliation, address or the like), identification information for the access app, identification of which lockbox or group of lockboxes the user and/or app is preapproved to access (if a limit is imposed), evidence of the current update code, the PIN entered, and the like.

The lockbox receives the data and determines whether access will be granted. If the lockbox grants access, it unlatches 882 the key container and communicates 884 an indication of success to the access app (which displays 886 the success to the user (e.g., via pop-up or a full success screen)). The app may also then cause the mobile phone to display any instructions regarding access (e.g., instructions appropriate to the particular model of lockbox on how to open the lockbox). For example, the instruction may indicate that a spring-loaded lockbox cover/door has opened to expose the key. Alternatively, the mobile telephone may indicate that the user has to take some particular step to open the lockbox such as pressing or pulling a particular location on the cover/door of the key container or body of the lockbox to release a mechanical latch after the lockbox actuator has unlocked that latch or unlocked another latch.

Thus, in this example, the app must have the correct access credential/authorization information, but the lockbox makes the determination whether to grant access. Yet other security protocols and enhancements are possible.

If the lockbox determines the electronic key invalid, the lockbox may transmit 890 a signal indicating refusal back to the mobile telephone. The handling of this signal by the mobile telephone may be done in a conventional manner appropriate to the baseline system (e.g., prompting some revalidation or other action required of the user).

In one group of examples, the success information sent by the lockbox includes lockbox identifying information (e.g., a lockbox serial number) and a confirmation of opening or unlocking.

Based upon the confirmation information received from the lockbox, the mobile telephone may be programmed by the app to undertake one or more of several actions. First, the lockbox serial number and confirmation of opening may be logged 920 along with date and time taken from the phone's own processor or from a processor onboard the lockbox. The app may associate this log information with the identifying information of the user and/or mobile phone and the biometric and non-biometric identifying information of the visitor and the app may cause the mobile phone to transmit 930 all such information to the central authority or may store it for future transmission to the central authority.

The server(s)/database(s) of the central authority may be programmed to receive and store the information so that records of access may be maintained which may include: identification of the lockbox and/or premises; the time/date of access; the user identity or other credential (e.g., credential of the mobile telephone); and the visitor biometric and non-biometric identifying information. As noted above, if real-time communication is not available, the aforementioned information may be retained in the mobile phone for transmission once communication is reestablished or at some specified interval/condition (e.g., at the next periodic update of the credential).

Figure 7:
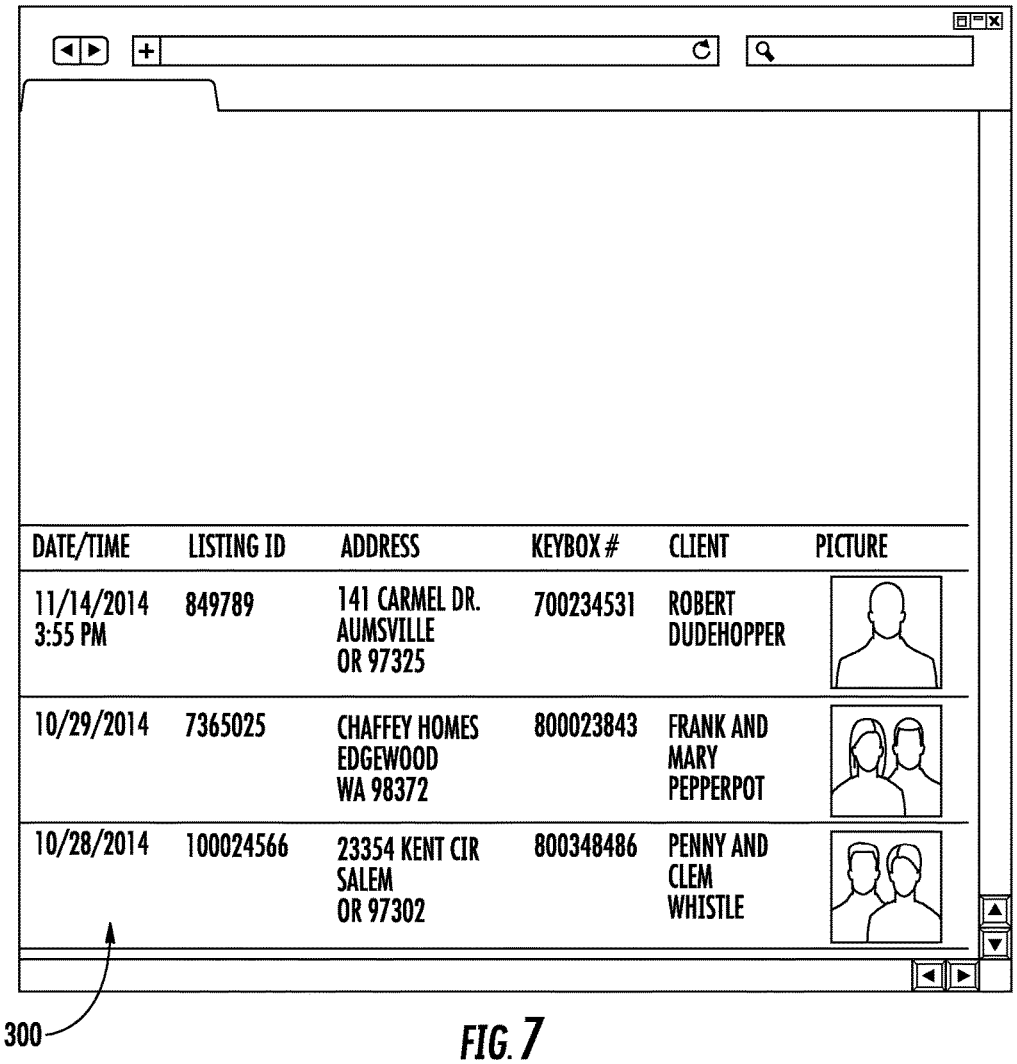
FIG. 7 is an exemplary browser interface for reviewing visit data.

The server(s)/database(s) of the central authority may be programmed/configured to provide report information in a number of possible formats and via a number of possible avenues. For example, reports may be delivered via an HTML protocol to web browsers running on computers of the listing agency, showing agency, or central authority. FIG. 7 shows a simplified screen shot of a web interface as might be generated for the showing agent. This may include a frame 300 that has a record of showings that may be displayed in any appropriate format. Exemplary table format has columns for date, listing number, address, lockbox serial number, visitor name, and visitor photograph. Various menu buttons, etc. may be displayed elsewhere in the browser window.

A further variation may apply to properties other than premises. One example is a vehicle retailing system wherein vehicles replace the premises and vehicle key lockboxes replace the lockboxes. The real estate agent is replaced by a sales representative. The prospective purchaser/premises visitor is replaced by a prospective customer/test driver. In one example, instead of having a controllable shackle for attaching to a premises doorknob or the like, the vehicle key lockbox has a hanger for hanging the lockbox from the upper edge of a window.

In an exemplary vehicle retailing system, the roles of listing agency and selling agency of the real estate system described above may be merged as the vehicle dealership (or dealership group). Similarly, the role of a local real estate board in credential-issuing may also be assumed by the dealership or dealership group.

The vehicle retailing system may offer further variations in that it may often be used when the sales representative accompanies the test driver and/or when the test driver takes the test drive alone.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Various illustrated temporal orders may be changes including performing or not certain acts simultaneously. Accordingly, other embodiments are within the scope of the following claims.

What is claimed is:

1. A lockbox access apparatus comprising a wireless communications device for use by a user and having a stored program configured to:

cause the wireless communications device to communicate an access request to the lockbox; and receive lockbox identifying information from the lockbox, wherein the wireless communication device is further configured to:

take entry of non-biometric identifying information of an individual other than the user;

record biometric identifying information of the individual; and transmit the lockbox identifying information, the biometric identifying information, and the non-biometric identifying information to a remote destination.

2. The lockbox access apparatus of claim 1, wherein the stored program is configured to receive said lockbox identifying information as a result of the communication of the access request.

3. The lockbox access apparatus of claim 1, wherein the stored program is configured to prompt the user to select between:

said recording of the biometric identifying information; and selection of already stored biometric identifying information.

4. The lockbox access apparatus of claim 1, wherein the biometrtic identifying information comprises a photograph.

5. The lockbox access apparatus of claim 1, wherein the stored program is configured to prompt the user for entry of personal security information of the user.

6. The lockbox access apparatus of claim 1, wherein the personal security information is a PIN.

7. The lockbox access apparatus of claim 1, wherein the wireless communications device is a wireless telephone.

8. The lockbox access apparatus of claim 1, wherein the wireless communications device is configured to initiate the communication to the remote destination via a data communication sent over the wireless communications device's wireless carrier network.

9. The lockbox access apparatus of claim 1, wherein the remote destination to which the wireless communications device initiates the communication includes a central authority having a computer receptive to communications from the wireless communications device over the wireless communications device's wireless carrier network.

10. The lockbox access apparatus of claim 1, wherein the wireless communications device and the lockbox are configured such that the access request is communicated wirelessly.

11. The lockbox access apparatus of claim 10, wherein the wireless communication includes Bluetooth communication.

12. A method for using the apparatus of claim 1, the method comprising:

recording with the wireless communication device said biometric identifying information of the individual;

communicating via the wireless communications device the access request to the lockbox and transmitting with the wireless communication device the lockbox identifying information, the biometric identifying information, and the non-biometric identifying information to said remote destination.

13. The method of claim 12 further comprising:

taking entry with the wireless communication device of said non-biometric identifying information.

14. The method of claim 12 wherein:

the recording is via taking a digital photograph.

15. The method of claim 12 wherein:

the lockbox is used to secure a key to a premises; and the individual is a visitor.

16. The method of claim 12 wherein:

the lockbox is used to secure a key to a vehicle; and the individual is a prospective test driver of the vehicle.

17. A lockbox access apparatus system comprising one or more servers having a stored program configured to:

receive from a wireless communication device of a user:

identifying information of the user;

lockbox identifying information; and biometric identifying information of an individual other than the user seeking access to a property secured via the lockbox, and non-biometric identifying information of the individual.

18. The system of claim 17 wherein the stored program is further configured to:

transmit to said wireless communications device a credential allowing the wireless communications device to open said lockbox.

19. The system of claim 17 wherein the stored program is configured to:

generate a report output for a remote device that includes, in visual form, the biometric identifying information and the non-biometric identifying information.

20. The system of claim 17 further comprising:

at least one said wireless communication device.

21. A lockbox access apparatus system comprising one or more devices having a stored program configured to:

verify storage of biometric identifying information of an individual seeking access to a property secured via a lockbox and non-biometric identifying information of the individual; and responsive to the verification, communicate an access request to the lockbox ; and receive lockbox identifying information.

22. The lockbox access apparatus system of claim 21 wherein the one of more devices comprise:

a wireless communication device; and one or more servers.

23. A method for using a lockbox access apparatus, the lockbox access apparatus comprising a wireless communications device having a stored program configured to:

cause the wireless communications device to communicate an access request to a lockbox; and receive lockbox identifying information from the lockbox, wherein the wireless communication device is further configured to:

record biometric identifying information of an individual;

take entry from a user of non-biometric identifying information of the individual; and transmit the lockbox identifying information, the biometric identifying information, and the non-biometric identifying information to a remote destination, the method comprising:

recording with the wireless communication device said biometric identifying information of the individual, biometric identifying information of the individual not already stored at the remote destination;

communicating via the wireless communications device the access request to the lockbox; and transmitting with the wireless communication device the lockbox identifying information, the biometric identifying information, and the non-biometric identifying information to said remote destination.

24. The method of claim 23 further comprising:

verifying storage of the biometric identifying information and the non-biometric identifying information as a precondition.

* * * * *